US012292252B1

(12) United States Patent
Alexander et al.

(10) Patent No.: US 12,292,252 B1
(45) Date of Patent: May 6, 2025

(54) FEEDER DOOR AND METHOD OF USE

(71) Applicant: TMP WEAPONS, LLC, Reno, NV (US)

(72) Inventors: Joshua Phillip Alexander, Scottsdale, AZ (US); Stephen McKinnley Estep, New River, AZ (US)

(73) Assignee: TMP Weapons, LLC, Reno, NV (US)

( * ) Notice: Subject to any disclaimer, the term of this patent is extended or adjusted under 35 U.S.C. 154(b) by 0 days.

(21) Appl. No.: 18/531,479

(22) Filed: Dec. 6, 2023

(51) Int. Cl.
*F41A 9/36* (2006.01)

(52) U.S. Cl.
CPC ..... *F41A 9/36* (2013.01)

(58) Field of Classification Search
CPC ..... F41A 9/35; F41A 9/36
USPC ..... 89/9, 12, 13.05
See application file for complete search history.

(56) References Cited

U.S. PATENT DOCUMENTS 499,534 A * 6/1863 Gatling ..... F41A 9/02 89/33.17
3,380,341 A * 4/1968 Chiabrandy ..... F41F 1/10 89/12
6,443,044 B1 * 9/2002 Dillon ..... F41A 9/36 89/12
7,013,789 B2 * 3/2006 Dillon ..... F41F 1/10 89/12
8,006,603 B2 8/2011 Gardwood
2011/0120292 A1 * 5/2011 Garwood ..... F41A 9/36 89/33.25
2017/0268840 A1 * 9/2017 Rowe ..... F41A 35/02

* cited by examiner

*Primary Examiner* — Bret Hayes
(74) *Attorney, Agent, or Firm* — Procopio, Cory, Hargreaves & Savitch LLP

(57) ABSTRACT

A feeder door of a feeder of a machine gun, the feeder including a feeder housing and the feeder door spring-loaded and pivotally coupled via a pivotal coupling to the feeder housing between at least an open position and a closed position, the feeder door comprising a base including a slot; a retainer lever; and a pivotal coupling independent of the feeder door and feeder housing pivotal coupling configured to spring-load and pivotally couple the retainer lever to the feeder housing between at least a stowed position with the retainer lever retracted in the slot of the base of the feeder door and a deployed position with the deployable portion extending outwardly from the slot of the base feeder door.

11 Claims, 5 Drawing Sheets

FEEDER DOOR AND METHOD OF USE

FIELD OF THE INVENTION

The present invention relates to feeder door of feeder/delinker of a machine gun.

SUMMARY OF THE INVENTION

An aspect of the invention involves a feeder door of a feeder of a machine gun, the feeder including a feeder housing and the feeder door spring-loaded and pivotally coupled via a pivotal coupling to the feeder housing between at least an open position and a closed position, the feeder door comprising a base including a slot; a retainer lever; and a pivotal coupling independent of the feeder door and feeder housing pivotal coupling configured to spring-load and pivotally couple the retainer lever to the feeder housing between at least a stowed position with the retainer lever retracted in the slot of the base of the feeder door and a deployed position with the deployable portion extending outwardly from the slot of the base feeder door.

One or more implementations of the aspect of the invention described immediately above includes one or more of the following: the pivotal coupling of the feeder door is a retainer lever torsion spring; the retainer lever includes a retainer lever arm and a retainer lever thumb pad; the retainer lever arm includes a lateral width and the retainer lever thumb pad includes a lateral width greater than the lateral width of the retainer lever arm; the retainer lever thumb pad includes a recess; the retainer lever includes a retainer lever stop configured to rest on a feeder retainer lever stop; a release lever including a lip configured to engage a lever stop lock to lock the feeder door in the closed position; and/or the release lever is spring-loaded and pivotally coupled to the base, the release lever pivotal about an axis and the feeder door pivotal about an axis parallel to the axis of the release lever.

Another aspect of the invention involves a method of using a feeder door of a feeder of a machine gun, the feeder including a feeder housing and the feeder door spring-loaded and pivotally coupled via a pivotal coupling to the feeder housing between at least an open position and a closed position, the feeder door comprising a base including a slot, a retainer lever, and a pivotal coupling independent of the feeder door and feeder housing pivotal coupling configured to spring-load and pivotally couple the retainer lever to the feeder housing between at least a stowed position with the retainer lever retracted in the slot of the base of the feeder door and a deployed position with the deployable portion extending outwardly from the slot of the base feeder door, the method comprising pivoting the feeder door relative to the feeder housing with the feeder door and feeder housing pivotal coupling; and pivoting the retainer lever relative to the feeder housing with the retainer lever and feeder housing pivotal coupling independently of the feeder door and feeder housing pivotal coupling.

One or more implementations of the aspect of the invention described immediately above includes one or more of the following: the retainer lever and feeder housing pivotal coupling is a retainer lever torsion spring, and pivoting includes pivoting the retainer lever relative to the feeder housing with retainer lever torsion spring independently of the feeder door and feeder housing pivotal coupling; and/or the retainer lever includes a retainer lever arm and a retainer lever thumb pad, and the method further comprising holding down the retainer lever with one's thumb on the retainer lever thumb pad.

BRIEF DESCRIPTION OF DRAWINGS

The accompanying drawings, which are incorporated in and form a part of this specification illustrate embodiments of the invention and together with the description, serve to explain the principles of the invention.

DESCRIPTION OF EMBODIMENT OF THE INVENTION

With reference to FIGS. 1-5, an embodiment of a feeder door 10 with an independent retainer lever 11 for a M134 minigun 110 or similar machine gun and method of using the same will be described.

Figure 1:
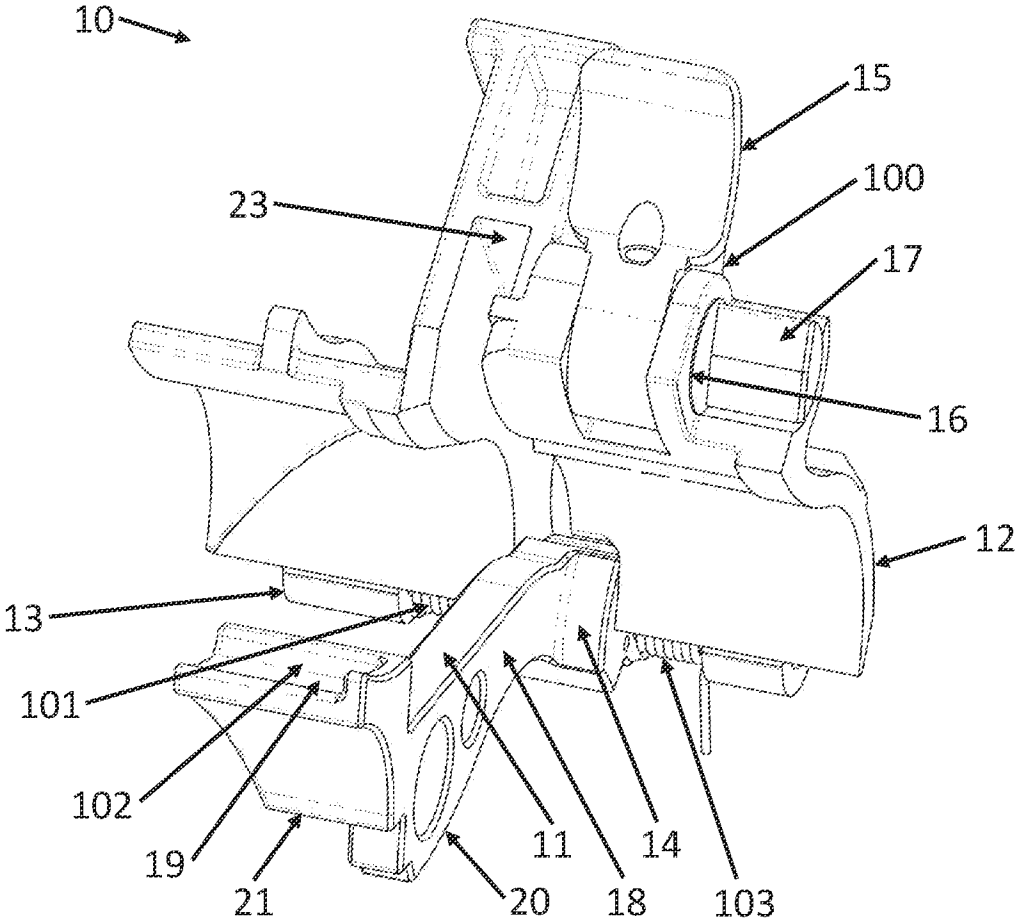
FIG. 1 is a bottom perspective view of a feeder door and retainer lever.
Figure 2:
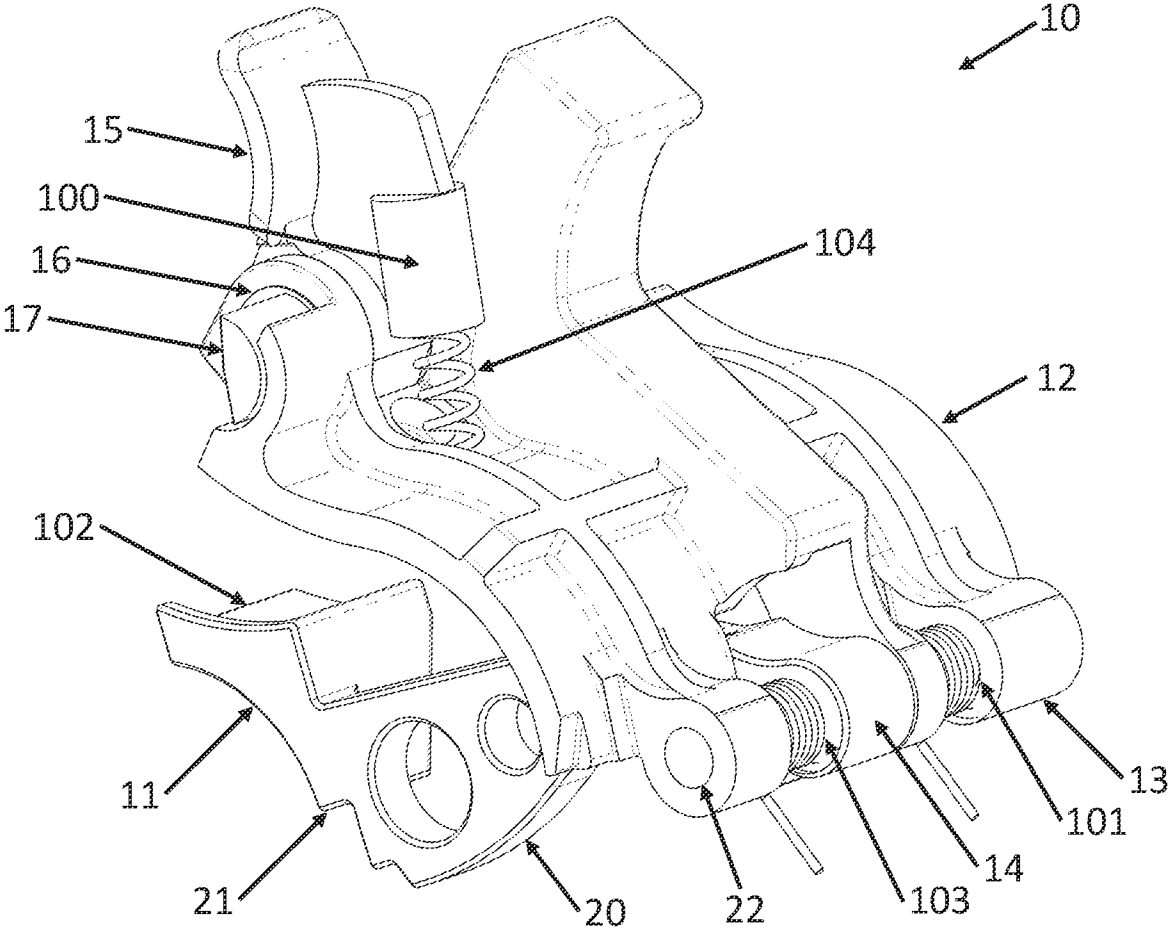
FIG. 2 is top perspective view of the feeder door and retainer lever of FIG. 1.

FIGS. 1 and 2 illustrate the feeder door 10 removed from feeder/delinker housing 30 of feeder/delinker 35. Door 10 includes base 12 and a retainer lever 11. The feeder door 10 is spring-loaded and pivotally coupled to the feeder housing 30 via door torsion spring 101 and door hinge 13. Retainer lever 11 is an independent retainer lever mechanism that is pivotally spring loaded via retainer lever hinge 14 and retainer lever torsion spring 103 to a door pivot pin 22 for pivotal movement in and out of slot or opening 23 formed in base 12.

Retainer lever 11 includes a retainer lever arm 18 with a bottom surface 20 that bears against a cartridge 40 disposed in stripper sprocket 105, a built-in retainer lever stop 21 that rests easily on feeder retainer lever stop 107 once the retainer lever 11 is pulled down, a retainer lever thumb pad 102 with a recess 19 to allow for enhanced loading capabilities as described below. The retainer lever thumb pad 102 is wider than the retainer lever arm 18 (i.e., lateral width of retainer lever thumb pad 102 is greater than lateral width of retainer lever arm 18).

Release lever 15 is also pivotally spring loaded and coupled to base 12 via lever spring 104, lever spring mount 100, and lever pivot 16, and includes tooth or lip 17. The release lever 15 pivots in the same direction as the direction that the feeder door 10 pivots; the release lever 15 and the feeder door 10 pivot about parallel axes. When the feeder door 10 is in the closed position illustrated in FIG. 5, lip 17 engages lever stop lock 106 and prevents the feeder door 10 from opening.

Figure 3:
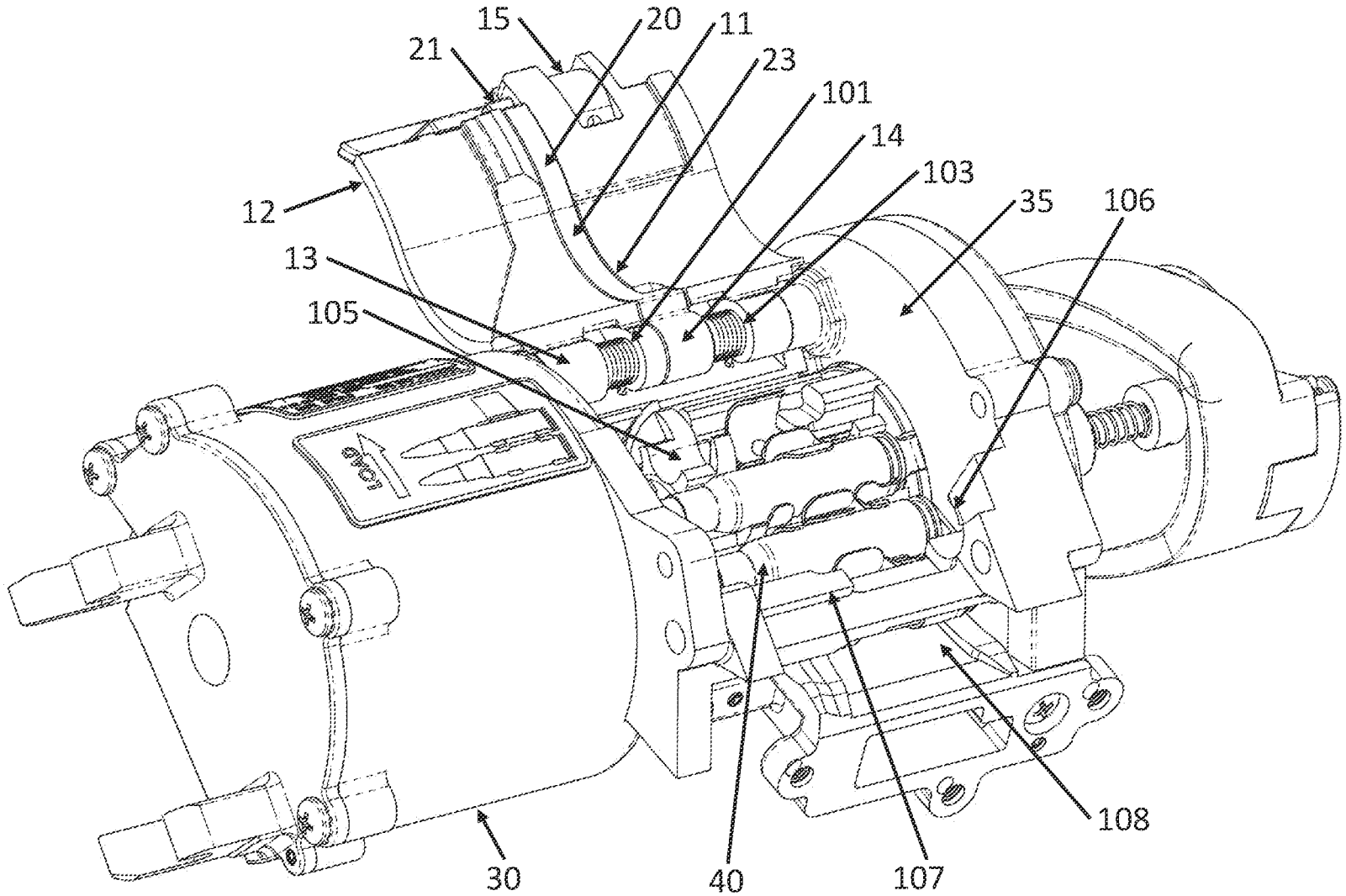
FIG. 3 is a perspective view illustrating an open position of both feeder door and retainer lever of FIG. 1.
Figure 4:
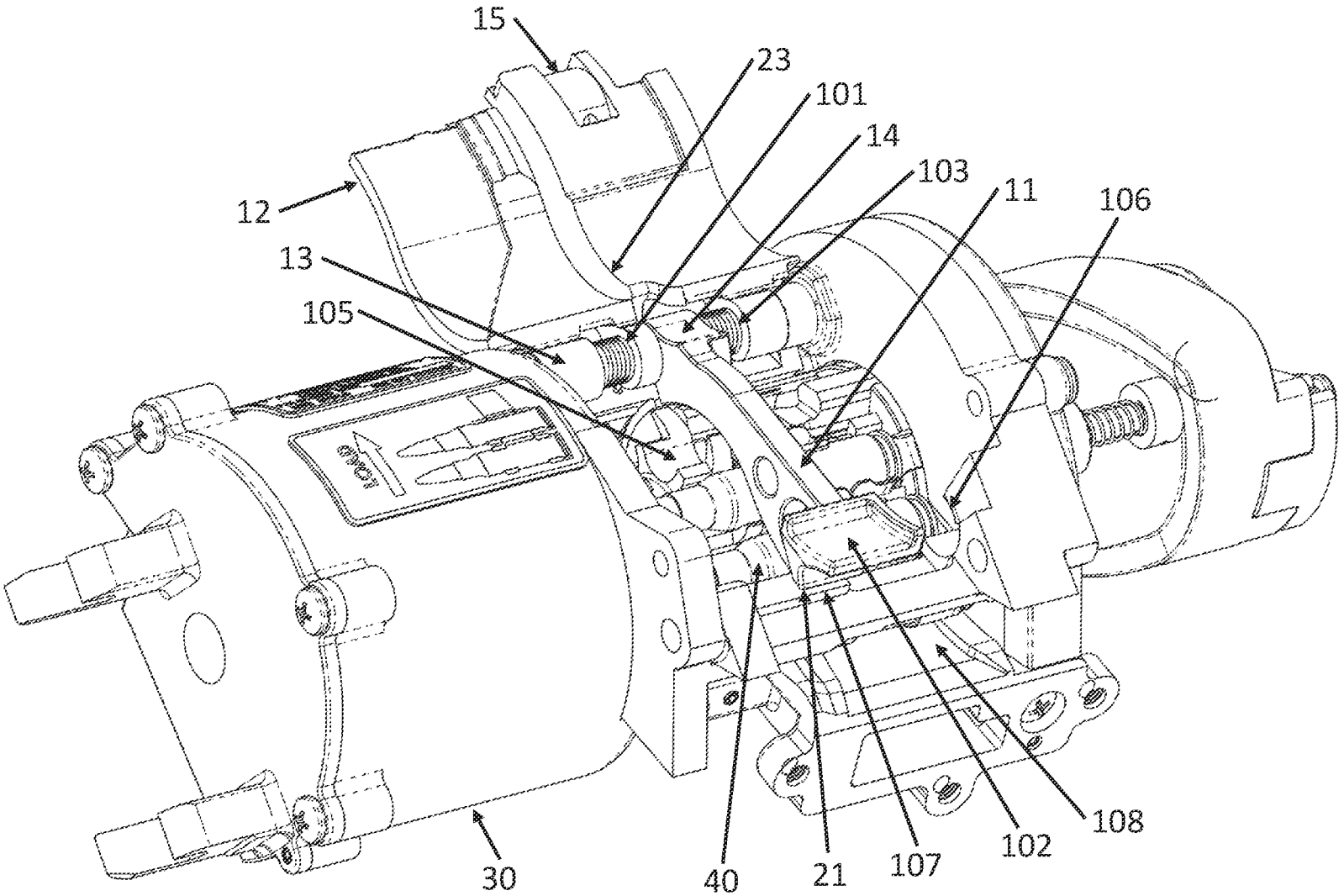
FIG. 4 is a perspective view further illustrating an open position of feeder door and force applied to down position of retainer lever of FIG. 1.
Figure 5:
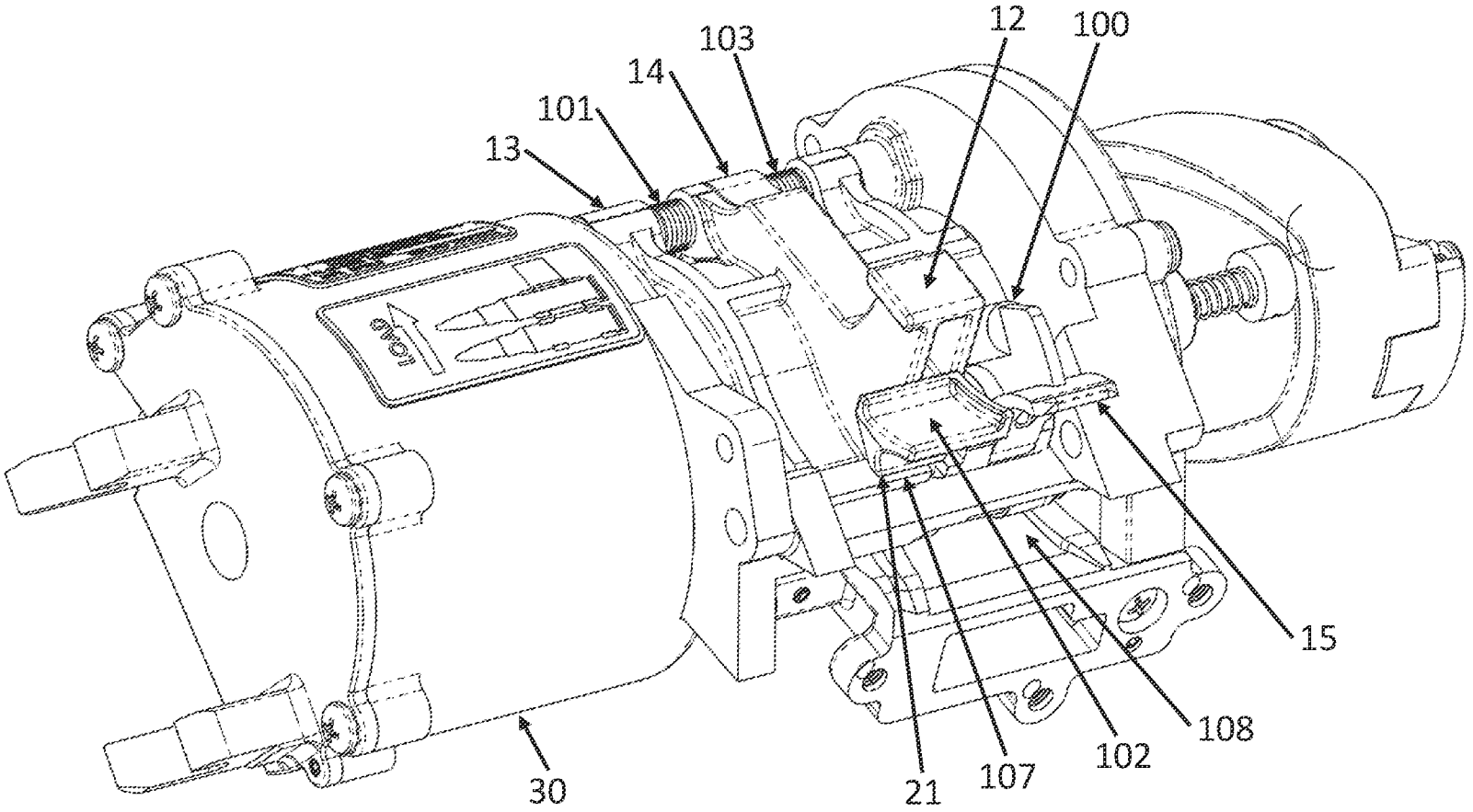
FIG. 5 is a perspective view further illustrating a closed/locked position of both feeder door and retainer lever of FIG. 1.

In use, with the door 10 in the closed/locked position shown in FIG. 5, a user manually displaces lever 15 to disengage lip 17 from lever stop lock 106 and then opens door 10 to the open position shown in FIG. 3 to allow access to the interior of the feeder/delinker 35 so a user can position a cartridge 40, which normally enters the feeder/delinker 35 via cartridge inlet 108, in the interior of the feeder/delinker 35. The user positions a cartridge 40 in the interior of the feeder/delinker 35, holds the cartridge 40 in position in with one hand and with the other hand grabs retainer lever thumb pad 102, which allows for enhanced loading capabilities, and brings the retainer lever 11 down to the stop position shown in FIG. 4 so that the built-in retainer lever stop 21 rests easily on feeder retainer lever stop 107 and the bottom surface 20 of the retainer lever 11 rests on and holds the cartridge 40 in place. Then, the operator takes the previous hand off the cartridge 40, continues to hold down the retainer lever 11 with the retainer lever thumb pad 102, and uses the other hand to grab base 12 and lever 15, and push down the single door 11 until the lip 17 snaps into/engages lever stop lock 106 and holds door 10 in the closed position shown in FIG. 5.

This single feeder door design with an independent retainer lever 11 as a separate component from the door 10 (i.e., dual independent component assembly design enabled by the retainer lever torsion spring 103 allowing the retainer lever 11 to stand independently on the door pivot pin, enabling its free movement) allows the retainer lever to move freely and separately from the single door 10, improving ammo loading.

The figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

We claim:

1. A feeder door of a feeder of a machine gun, the feeder including a feeder housing and the feeder door spring-loaded and pivotally coupled via a pivotal coupling to the feeder housing between at least an open position and a closed position, the feeder door comprising:

a base including a slot;

a retainer lever;

a pivotal coupling independent of the feeder door and feeder housing pivotal coupling configured to spring-load and pivotally couple the retainer lever to the feeder housing between at least a stowed position with the retainer lever retracted in the slot of the base of the feeder door and a deployed position with the deployable portion extending outwardly from the slot of the base feeder door, wherein:

in the feeder door open position and the retainer lever stowed position, where an interior of feeder is accessed so a user can position a cartridge, the retainer lever is spring-loaded, urged towards and retracted in the slot of the base of the feeder door, and in the feeder door open position and the retainer lever deployed position, the retainer lever is moved manually by a user outwardly from the slot of the base feeder door, overcoming the spring-load, and manually urged against the cartridge, holding the cartridge in place.

2. The feeder door of claim 1, wherein the pivotal coupling of the feeder door is a retainer lever torsion spring.

3. The feeder door of claim 1, wherein the retainer lever includes a retainer lever arm and a retainer lever thumb pad.

4. The feeder door of claim 3, wherein the retainer lever arm includes a lateral width and the retainer lever thumb pad includes a lateral width greater than the lateral width of the retainer lever arm.

5. The feeder door of claim 3, wherein the retainer lever thumb pad includes a recess.

6. The feeder door of claim 1, wherein the retainer lever includes a retainer lever stop configured to rest on a feeder retainer lever stop.

7. The feeder door of claim 1, further including a release lever including a lip configured to engage a lever stop lock to lock the feeder door in the closed position.

8. The feeder door of claim 1, wherein the release lever is spring-loaded and pivotally coupled to the base, the release lever pivotal about an axis and the feeder door pivotal about an axis parallel to the axis of the release lever.

9. A method of using the feeder door of claim 1, comprising:

pivoting the feeder door relative to the feeder housing with the feeder door and feeder housing pivotal coupling;

pivoting the retainer lever relative to the feeder housing with the retainer lever and feeder housing pivotal coupling independently of the feeder door and feeder housing pivotal coupling.

10. The method of claim 9, wherein the retainer lever and feeder housing pivotal coupling is a retainer lever torsion spring, and pivoting includes pivoting the retainer lever relative to the feeder housing with retainer lever torsion spring independently of the feeder door and feeder housing pivotal coupling.

11. The method of claim 9, wherein the retainer lever includes a retainer lever arm and a retainer lever thumb pad, and the method further comprising holding down the retainer lever with one's thumb on the retainer lever thumb pad.

* * * * *